United States Patent [19]

Hayashi

[11] Patent Number: 5,056,148

[45] Date of Patent: Oct. 8, 1991

[54] OUTPUT CIRCUIT OF AUDIO DEVICE

[75] Inventor: Satoru Hayashi, Shizuoka, Japan

[73] Assignee: Kabushiki Kaisha Kawai Gakki Seisakusho, Shizuoka, Japan

[21] Appl. No.: 616,968

[22] Filed: Nov. 21, 1990

[51] Int. Cl.[5] ..... H04H 5/00

[52] U.S. Cl. ..... 381/11; 381/1; 381/25

[58] Field of Search ..... 381/1, 24, 25, 28, 74, 381/80, 81, 85, 123, 11

[56] References Cited

U.S. PATENT DOCUMENTS 4,433,209 2/1984 Kurosawa et al. ..... 381/1

FOREIGN PATENT DOCUMENTS 0072723 3/1990 Japan ..... 381/11

*Primary Examiner*—James L. Dwyer
*Assistant Examiner*—Sylvia Chen
*Attorney, Agent, or Firm*—Sughrue, Mion, Zinn, Macpeak and Seas

[57] ABSTRACT

An output circuit of a stereo type audio device includes a switch state detection switch which responds to an open state of a normally closed internal switch of an output jack of a first channel to separate a stereo signal source from the first and a second channels of the stereo device and connect a monoral signal source to the second channel.

2 Claims, 1 Drawing Sheet

OUTPUT CIRCUIT OF AUDIO DEVICE

BACKGROUND OF THE INVENTION

The present invention relates to an output circuit of a stereo/monaural audio device, by which a monaural signal reproduction can be possible without interference between left and right channel signals in the stereo audio device.

In an audio device for reproduction of stereo signals, a conventional output circuit by which a monaural signal reproduction is possible by switching between a monaural circuit and a stereo circuit has a construction such as shown in FIG. 3. In FIG. 3, the output circuit includes a left channel circuit 10 and a circuit 20 which is used as a right channel circuit as well as a monaural signal circuit. Reference numerals 11 and 21 depict operational amplifiers, 12 a jack having an internal switch 13, 22 a jack having no internal switch, 14 and 24 plugs for deriving output signals, 15 a stereo/monaural changeover switch and 16 and 26 audio systems.

In stereo signal reproduction, left and right channel signals are supplied to the left channel 10 and the right channel 20, respectively. After amplified by the operational amplifiers 11 and 21, these signals appear at the jacks 12 and 22, respectively. When the plugs 14 and 24 are inserted into the the jacks 12 and 22, respectively, the internal switch 13 of the jack 12 is opened and therefore the respective signals are allowed to pass to the audio systems 16 and 26, respectively, to thereby produce stereo sound.

When the plug 14 is pulled out from the jack 12 under this condition, the internal switch 13 thereof is closed, so that an output of the operational amplifier 11 is combined with the output of the operational amplifier 21. Since, at this time, the changeover switch 15 is also actuated to the shown position, the right channel signal is output from both of the audio systems 16 and 26, simultaneously. Besides, for a monaural operation based on a monaural input signal supplied to only the right channel, it is possible to supply the monaural signal to both channels and shift phase of the monaural signal in one channel with respect to that in the other channel. The phase shifted two monaural signals are supplied to the respective sound systems to provide stereo-like sound.

When the output plug 14 of the right channel of the stereo device operating in a stereo mode is pulled out, an operation like monaural operation can be obtained and a monaural signal is derived from the output plug 24 of the left channel. In such case, however, signals on the both channels may interfere with each other at certain frequencies and/or at a certain timing, resulting in tone variation of the resultant output from the plug 24 or dropout of some portion of the signal.

SUMMARY OF THE INVENTION

An object of the present invention is to provide an output circuit of a stereo type audio device, which is simple in construction and can provide a monaural output from the stereo device operating in a stereo mode without signal interference between right and left channel signals thereof.

According to the present invention, the above and other objects can be achieved by a provision of switch state detection means for detecting a state of an internal switch of one of channels of a stereo device and stereo/monaural switch means responsive to an output of the switch state detection means for removing stereo signal in the channels when the internal switch is opened.

DETAILED DESCRIPTION OF THE PREFERRED EMBODIMENTS

Figure 1:
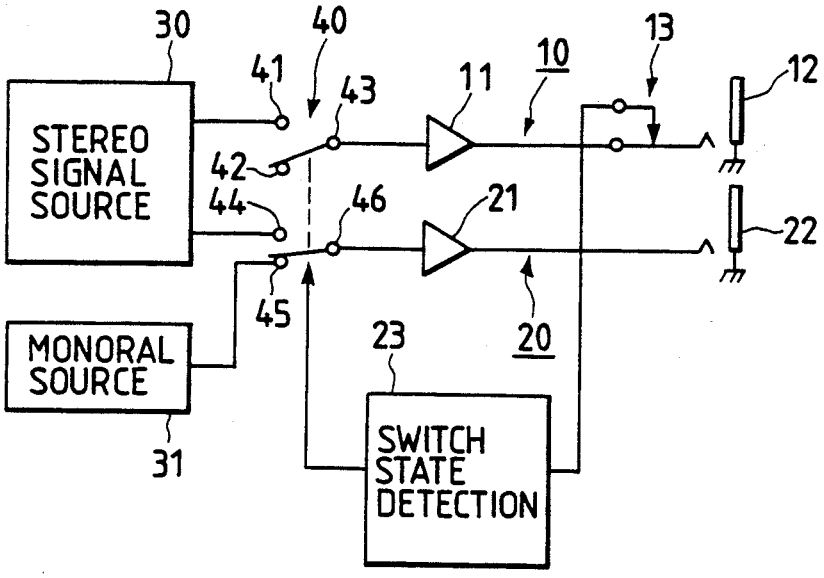
FIG. 1 is a schematic block circuit diagram of an embodiment of an output circuit according to the present invention.

In FIG. 1 showing an embodiment of the present invention, the output circuit includes a left channel circuit 10 including an operational amplifier 11 and a right channel circuit 20 which has an operational amplifier 21 and is also used as a monaural circuit. Input sides of these circuits 10 and 20 are connected to movable contacts 43 and 46 of a pair of changeover switches constituting a stereo/monaural switch 40 connected to a stereo signal source 30 which may be a stereo sound memory and a monaural signal source 31 which may be a monaural sound memory, respectively. Output sides thereof are connected to jacks 12 and 22, respectively. The jack 12 associated with the left channel 10 has a normally closed internal switch 13 and is adapted to receive a plug connected to one of stereo sound systems.

The changeover switch having the movable contact 43 has a first stationary contact 41 connected to one of outputs of the stereo signal source 30 and a second stationary contact 42 which is floating. The other changeover having the movable contact 46 has a first stationary contact 44 connected to the other output of the stereo signal source 30 and a second stationary contact 45 connected to the monaural signal source 31. The movable contacts 43 and 46 are ganged with each other so that, in one state of the stereo/monaural switch 40, they are connected to the stationary contacts 41 and 44, respectively, to establish a stereo mode operation and, in the other state, they are connected to the stationary contacts 42 and 45, respectively, so that the stereo signal source 30 is separated to establish a monaural operation.

A switch state detection circuit 23 has a detection input connected to a stationary contact of the internal switch 13 of the jack 12. The switch state detection circuit 23 detects state of the internal switch 13 and, when the internal switch 13 is opened by an insertion of the plug associated therewith into the jack 12, it controls the changeover switches of the stereo/monaural switch 40 such that the movable contacts 43 and 46 thereof are moved to the unillustrated positions in engagement with contacts 41 and 44, respectively, to supply stereo signal to the channels 10 and 20 to thereby establish the stereo mode operation.

When the internal switch 13 is closed by pulling out the plug, the state detection circuit 23 controls the stereo/monaural switch 40 to engage with contacts 42 and 45 as shown in FIG. 1 such that the stereo signal source 30 is disconnected and the monaural signal source 31 is connected to the channel 20 to provide a monaural signal through the jack 22 to the other stereo sound system. Therefore, there is no signal interference on the channel 20.

Figure 2:
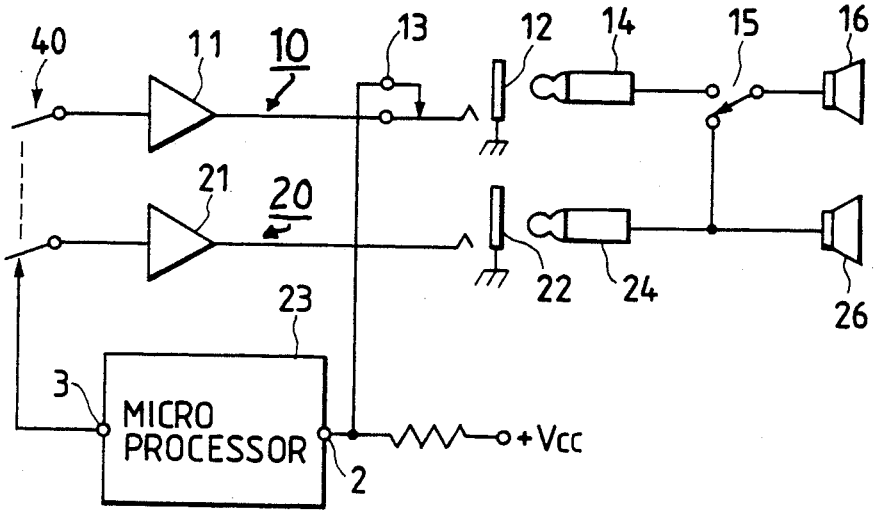
FIG. 2 is a concrete example of the embodiment of the present invention.
Figure 3:
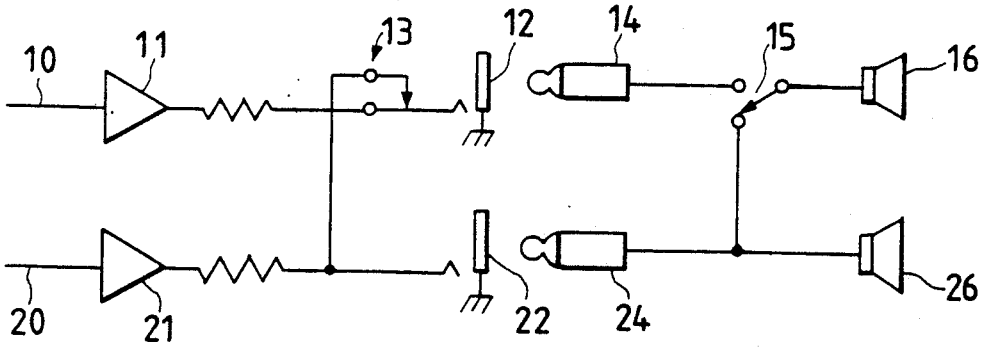
FIG. 3 PRIOR ART
FIG. 3 is a schematic block circuit diagram of an output circuit of a conventional stereo device.

FIG. 2 is a detailed circuit construction of the embodiment in FIG. 1. In FIG. 2, the switch state detection circuit 23 is constituted with a microprocessor having an input port 2 connected to the internal switch 13 and an output port 3. The input port 2 is supplied with a source voltage +Vcc.

When both of the plugs 14 and 24 are inserted into the jacks 12 and 22, respectively, the internal switch 13 is opened and, therefore, the source voltage +Vcc is applied to the input port of the microprocessor 23. The microprocessor 23 is programmed such that, upon the +Vcc input to the input port 2 thereof, it provides an output at the output port 3 thereof for controlling the changeover switches of the stereo/monaural switch 40 such that the movable contacts thereof are connected to the output terminals of the stereo signal source 30, respectively.

When the plug 14 is pulled out from the jack 12 under the condition to cause the stereo device to operate in monaural mode, the internal switch 13 is closed and an output signal "L" of the operational amplifier 11 is supplied to the input port 2 of the microprocessor 23 since an output impedance of the operational amplifier 11 is low. Since this signal "L" is an interrupt signal for the microprocessor 23, the program thereof runs to provide an output signal at the output port 3 upon which the stereo/monaural switch 40 is actuated to separate the stereo signal source 30 and instead thereof connect the monaural signal source 31 to the channel 20. At this time, since the changeover switch 15 associated with the plug 14 is put in the shown position, the monaural signal after amplified by the amplifier 21 is supplied to the sound systems 16 and 26, resulting in pure monaural sounds produced thereby.

As described above, according to the present invention, monaural signal will never be combined with stereo signal, and therefore it is possible to obtain pure monaural sound without interference.

What is claimed is:

1. A signal switching circuit for a stereo/monaural audio device, including:

a first channel having an input connected by a first switch to one of two outputs of a stereo signal source and having an output connected to a first stereo output jack with a second normally closed internal switch, a second channel having an input connected by said switch selectively to an other output of said stereo signal source or an output of a monaural signal source and having an output connected to a second stereo output jack with no internal switch said normally closed internal switch being adapted to be opened when a plug associated therewith and connected through a changeover switch to a first stereo output system is inserted into said first stereo output jack, said second stereo output jack being connected to a second stereo output system and adapted also to be used as an output jack for a monaural signal, and said signal switching circuit comprising switch state detection means for detecting an opening of said internal switch of said first stereo output jack to disconnect said stereo signal source from said inputs of said first and said second channels and connect said monaural signal source to said input of said second channel.

2. The signal switching circuit claimed in claim 1, wherein said switch state detection means comprises a microprocessor having an input port connected to said normally closed internal switch and to a d.c. voltage and an output port for providing a signal to said switch.

* * * * *